US008007336B2

(12) United States Patent
Liu et al.

(10) Patent No.: US 8,007,336 B2
(45) Date of Patent: Aug. 30, 2011

(54) FIELD EMISSION DISPLAY DEVICE

(75) Inventors: Peng Liu, Beijing (CN); Liang Liu, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 290 days.

(21) Appl. No.: 12/351,730

(22) Filed: Jan. 9, 2009

(65) Prior Publication Data

US 2009/0181594 A1 Jul. 16, 2009

(30) Foreign Application Priority Data

Jan. 11, 2008 (CN) ..... 2008 1 0065180

(51) Int. Cl.
*H01J 17/49* (2006.01)

(52) U.S. Cl. ..... 445/51; 313/495

(58) Field of Classification Search ..... 313/495–497; 445/51, 46, 24–25

See application file for complete search history.

(56) References Cited

U.S. PATENT DOCUMENTS

| | | | | |
|---|---|---|---|---|
| 5,192,240 | A | 3/1993 | Komatsu | |
| 6,011,567 | A | 1/2000 | Nakamura et al. | |
| 6,605,894 | B2 * | 8/2003 | Choi et al. | 313/495 |
| 7,012,362 | B2 | 3/2006 | Kawate et al. | |
| 7,064,474 | B2 * | 6/2006 | Liu et al. | 313/309 |
| 7,582,001 | B2 | 9/2009 | Kitamura et al. | |
| 7,739,790 | B2 | 6/2010 | Shimazu et al. | |
| 7,780,496 | B2 | 8/2010 | Liu et al. | |
| 2005/0067936 | A1 * | 3/2005 | Lee et al. | 313/309 |
| 2006/0061257 | A1 * | 3/2006 | Nakamoto | 313/496 |
| 2007/0075619 | A1 | 4/2007 | Jiang et al. | |
| 2007/0273267 | A1 * | 11/2007 | Miura et al. | 313/495 |
| 2009/0195140 | A1 | 8/2009 | Wei et al. | |

FOREIGN PATENT DOCUMENTS

| | | |
|---|---|---|
| CN | 1433039 | 7/2003 |
| CN | 1747102 A | 3/2006 |
| CN | 1790598 | 6/2006 |
| CN | 1941249 A | 4/2007 |

* cited by examiner

*Primary Examiner* — Anne Hines
(74) *Attorney, Agent, or Firm* — D. Austin Bonderer

(57) ABSTRACT

A method for manufacturing a field emission element includes the following steps. The insulating substrate is provided. At least one grid, a first electrode and a second electrode are formed on the insulating substrate. The first and second electrodes are within the grid. The insulating substrate having at least one grid, the first electrode and the second electrode is covered with a carbon nanotube structure. The carbon nanotube structure includes a plurality of carbon nanotubes successively extended from the second electrode to the first electrode. The carbon nanotubes between the first electrode and the second electrode are cut to form a plurality of substantially parallel electron emitters in the at least one grid. One end of each electron emitter is electrically connected to the second electrode and opposite end of each electron emitter faces towards the first electrode.

19 Claims, 3 Drawing Sheets

FIELD EMISSION DISPLAY DEVICE

BACKGROUND

1. Technical Field

The disclosure relates to a display device and, particularly, to a field emission display device.

2. Description of Related Art

Currently, because field emission display (FED) devices provide advantages such as low power consumption, fast response speed and high resolution, they are being actively developed.

Referring to FIG. 3, a conventional electrode plate 100, according to the prior art, of an FED device according to the prior art includes an insulating substrate 102, a plurality of electrode down-leads 104 arranged in rows, a plurality of electrode down-leads 106 arranged in columns intersecting the rows to form a matrix, and a plurality of electron emitting units 108. The lines 104 are parallel and spaced from each other on the insulating substrate 102. The lines 106 are also parallel and spaced from each other on the insulating substrate 102. The matrix includes a plurality of grids 118 where the electron emitting units 108 are located. A dielectric insulator 116 is disposed at each column and row intersection. Thus, the dielectric insulator 116 is configured to provide electric insulation between the lines 106 and the lines 104.

Each of the electron emitting units 108 includes an anode electrode 110 extending from a row of the electrode down-lead 104, and a cathode electrode 112 extending from a column of the electrode down-lead 106, and an electron emitter 114. Each electron emitter 114 has an electron emitter region 116 with one or multiple slits provided for the emission of electrons. If moderate voltage is applied to the electron emitter 114, electrons will emit from one end of the slit and across to the opposite end of the slit based on the electron tunneling process.

Generally, the electron emitter 114 is a conduction film, for example, a palladium oxide (PdO) film produced by ink-jet printing. The slits of the electron emitter region 116 are formed by applying voltage to the conduction film between the anode electrode 110 and the cathode electrode 112. In such case, the conduction film is split into two parts so that the slits of the electron emitter region 116 are formed due to deformation or some other alteration of the conduction film. It is understood that the slits where electrons emit are difficult to fabricate precisely based on present fabricating technology, e.g. shape and location of the slits are not easy to be controlled. Thus, every electron emitter 114 will have different electron emission characteristics preventing uniform electron emission.

What is needed, therefore, is a method for manufacturing a field emission element having improved uniformity of electron emission.

BRIEF DESCRIPTION OF THE DRAWINGS

Many aspects of the present method for manufacturing field emission element can be better understood with reference to the following drawings. The components in the drawings are not necessarily to scale, the emphasis instead being placed upon clearly illustrating the principles of the present method for manufacturing a field emission element.

Figure 1:
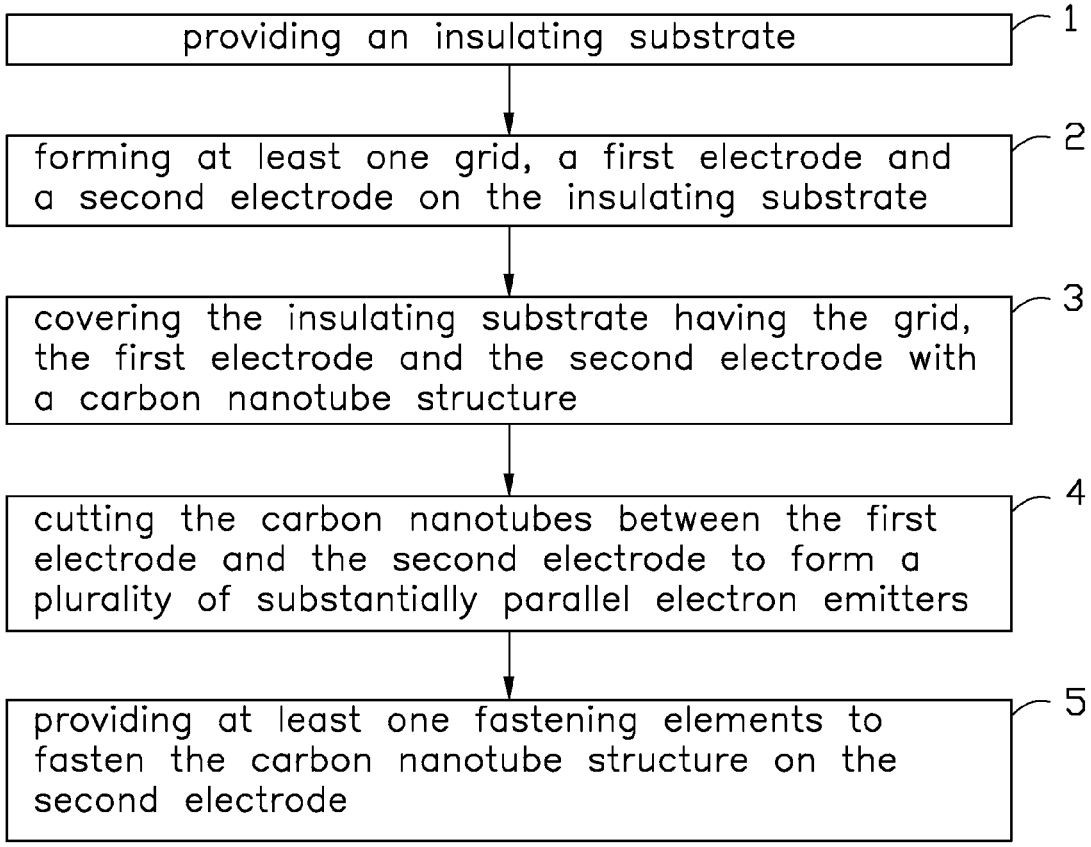
FIG. 1 is a flow chart of a method for manufacturing a field emission element, in accordance with an exemplary embodiment.

Corresponding reference characters indicate corresponding parts throughout the several views. The exemplifications set out herein illustrate at least one embodiment of the present method for manufacturing a field emission element, in one form, and such exemplifications are not to be construed as limiting the scope of the disclosure in any manner.

DETAILED DESCRIPTION OF THE EMBODIMENTS

Reference will now be made to the drawings to describe embodiments of the present method for manufacturing a field emission element, in detail.

Figure 2:
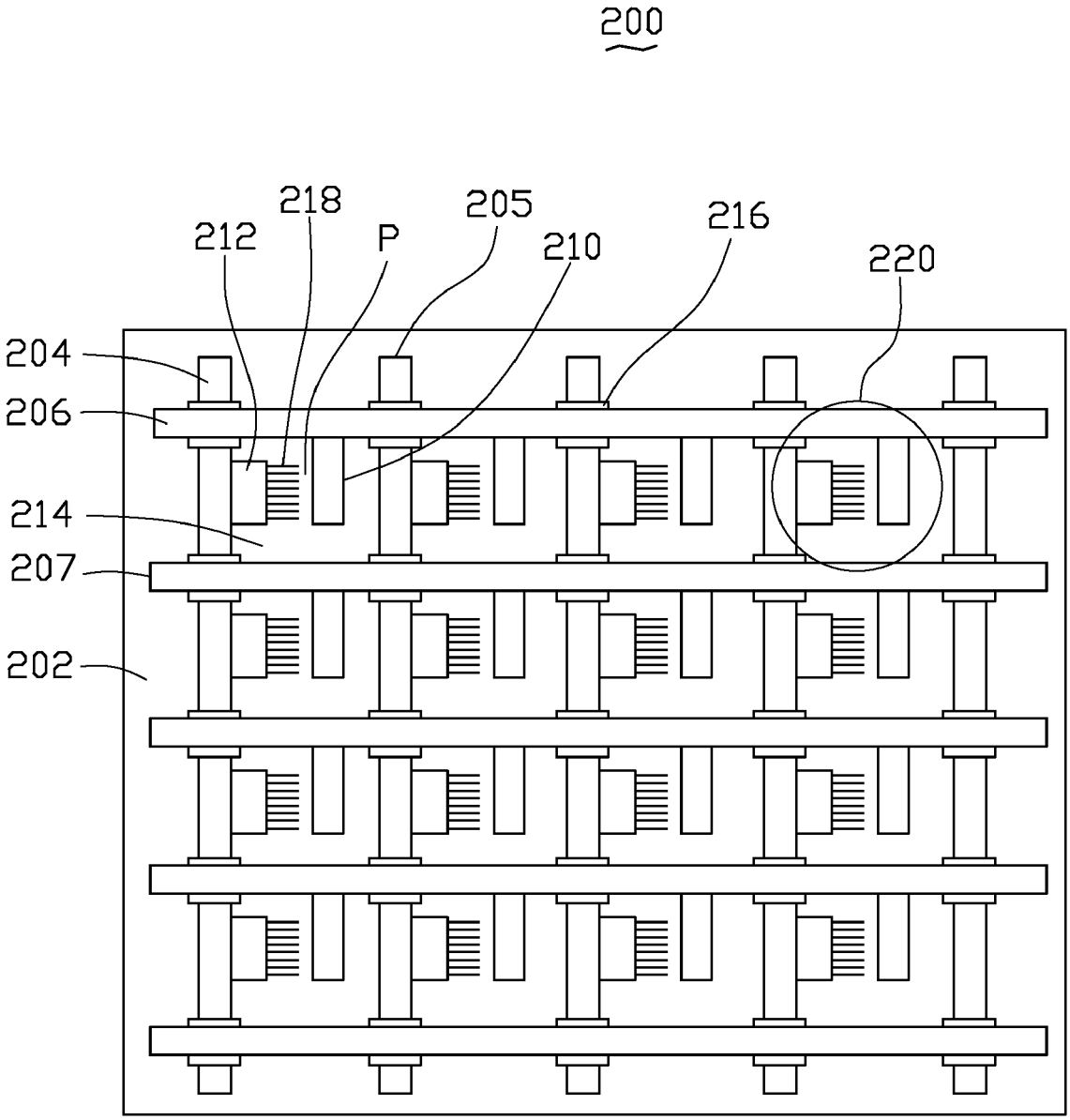
FIG. 2 is a plan view of a field emission element, in accordance with the exemplary embodiment.
Figure 3:
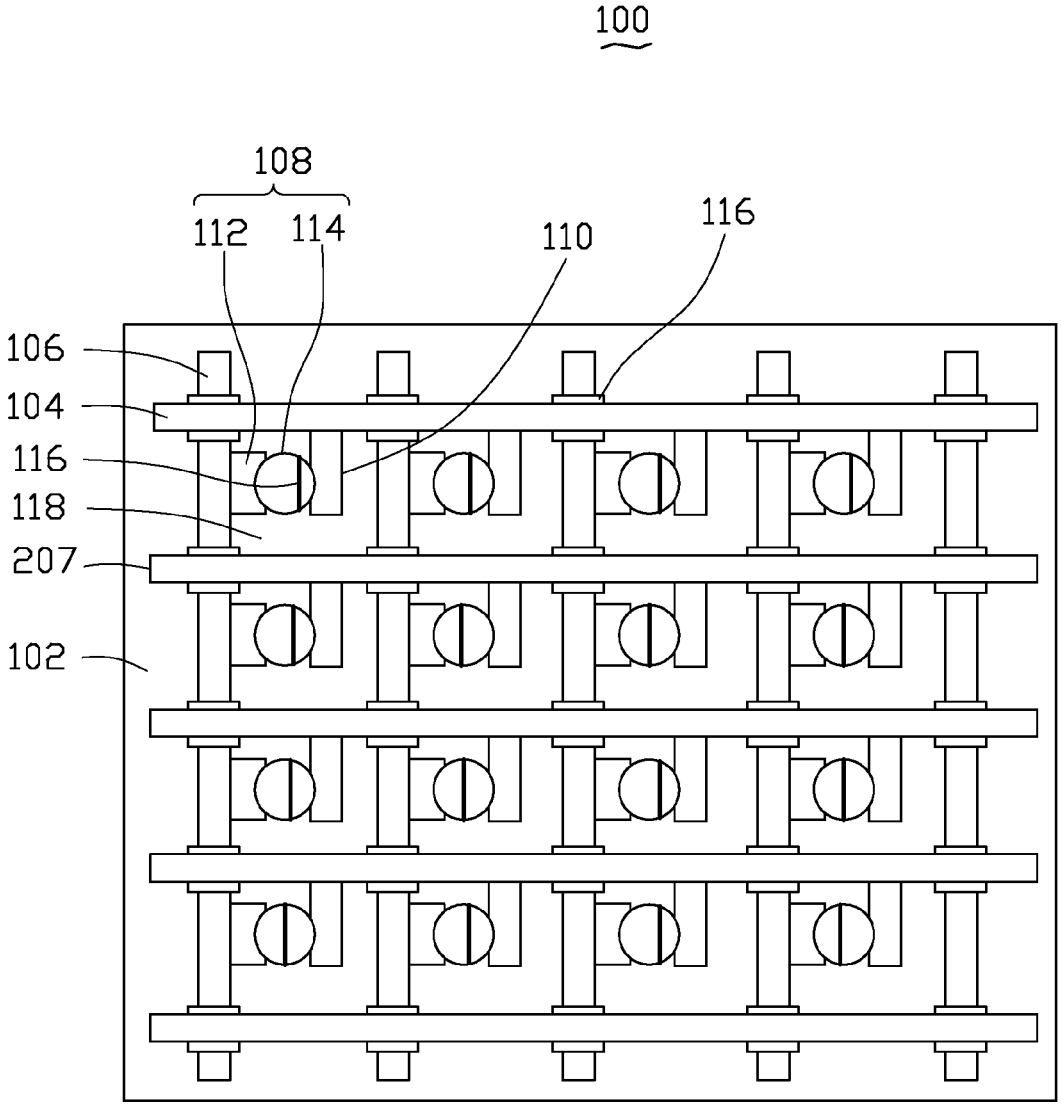
FIG. 3 (PRIOR ART)
FIG. 3 is a plan view of a conventional electrode plate according to the prior art.

Referring to FIG. 1 and FIG. 2, a method for manufacturing an FED device 200, according to an exemplary embodiment, includes, in step 1, providing an insulating substrate 202. In step 2, at least one grid 214, a first electrode and a second electrode are formed on the insulating substrate 202. In step 3, the insulating substrate 202 having the grid 214, the first electrode 210 and the second electrode 212 is covered with a carbon nanotube structure, wherein the carbon nanotube structure includes a plurality of carbon nanotubes, the carbon nanotubes are successively extended from the second electrode 212 to the first electrode 210. In step 4, the carbon nanotubes between the first electrode 210 and the second electrode 212 are cut to form a plurality of substantially parallel electron emitters 218, wherein one end of each electrode emitter 218 is electrically connected to the second electrode 212 and the opposite end of each electron emitter 218 is aligned towards the first electrode 210.

The method is described in more detail as follows.

In step 1, the insulating substrate 202 made of, for example, ceramics, glass, resins or quartz, is provided. In addition, the size and the thickness of the insulating substrate 202 can be chosen according to need. In this embodiment, the insulating substrate 202 is a glass substrate with a thickness of more than 1 mm (millimeter) and an edge length of more than 1 cm (centimeter).

In step 2, one or more grids 214 are formed on the insulating substrate 202. The following steps can form the grid 214. A first electrode down-lead 204 and a second electrode down-lead 205 substantially parallel to and spaced from each other are formed on the insulating substrate 202. Then, a third electrode down-lead 206 and a fourth electrode down-lead 207 are formed to intersect the first electrode down-lead 204 and the second electrode down-lead 205. The third electrode down-lead 206 and the fourth electrode down-lead 207 are substantially parallel to and spaced from each other. Thus, the first, second, third and fourth electrode down-leads 204, 205, 206, 207 are located on the periphery of the grid 214. It is to be understood that the second electrode down-lead 205 of one grid can act as the first electrode down-lead 204 of another adjacent grid while the fourth electrode down-lead 207 of one grid can act as the third electrode down-lead 206 of another adjacent grid. In addition, the first electrode down-lead 204 and the second electrode down-lead 205 are electrically insulated from the third electrode down-lead 206 and the fourth electrode down-lead 207. In the exemplary embodiment, before the step of forming the third electrode 206 and the fourth electrode 207, a plurality of insulating layers 216 are applied on intersections of any two electrode down-leads 204, 205, 206, 207, avoiding short-circuiting. The insulating layers 216 can be made of dielectric material.

In the exemplary embodiment, the electrode down-leads 204, 205, 206, 207 formed on the insulating substrate 202 is made of conductive material. For example, conductive slurry is applied on the insulating substrate 202 by a printing process, e.g. silk screen printing process. The conductive slurry may include metal powder, glass powder, and binder. In the exemplary embodiment, the metal powder can be silver powder and the binder can be terpineol or ethyl cellulose (EC). Particularly, the conductive slurry includes 50% to 90% (by weight) of the metal powder, 2% to 10% (by weight) of the glass powder, and 10% to 40% (by weight) of the binder. In the exemplary embodiment, each of the electrode down-leads 204, 205, 206, 207 is formed with a width ranging from 30 μm to 100 μm and with a thickness ranging from 10 μm to 50 μm. However, it is noted that dimensions of each electrode down-lead 204, 205, 206, 207 can vary corresponding to dimensions of each grid 214.

Referring to FIG. 2, the field emission element 200 of the exemplary embodiment has a plurality of grids 214 arranged in an array fashion. In such case, a plurality of the first electrode down-leads 204 and the second electrode down-leads 205 are arranged on the insulating substrate 202. The first electrode down-leads 204 and the second electrode down-leads 205 are alternatively arranged and spaced from each other. A plurality of the third electrode down-leads 206 and the fourth electrode down-leads 207 are arranged to cross the first electrode down-leads 204 and the second electrode down-leads 205. The third electrode down-leads 206 and the fourth electrode down-leads 207 are alternatively arranged and spaced from each other. In the exemplary embodiment, a distance between the first electrode down-lead 204 and the second electrode down-lead 205 is in a range from about 50 μm to about 2 cm. A distance between the third electrode down-lead 206 and the fourth electrode down-lead 207 is in a range from about 50 μm to about 2 cm.

In step 2, the first electrode 210 and the second electrode 212 may be formed by screen printing, sputtering or evaporating, within each grid 214. In addition, all the electrodes 210, 212 and all the electrode down-leads 204, 205, 206, 207 can be made contemporaneously. In the exemplary embodiment, the first electrode 210 and the second electrode 212 can be formed by printing the conductive slurry on the insulating substrate 202. The conductive slurry employed to form the first electrode 210 and the second electrode 212 is the same as used for the electrode down-leads 204, 205, 206, 207. In practice, the first electrodes 210 and the second electrodes 212 can be designed corresponding to a desired pattern as needed. In each grid 214, the first electrode 210 is disposed corresponding to and spaced from each second electrode 212. In addition, the first electrode 210 is connected to the third electrode down-lead 206 while the second electrode 212 is connected to the first electrode down-lead 204. Referring to FIG. 2, the first electrodes 210 arranged in a row of the grids 214 are electrically connected to the third electrode down-lead 206. In addition, the second electrodes 212 arranged in a column of the grids 214 are electrically connected to the first electrode down-lead 204. A distance from the first electrode 210 to the second electrode 212 is the same in every grid 214. In the present embodiment, the first electrode 210 serves as an anode and the second electrode 212 serves as a cathode.

In step 3, the carbon nanotube structure is provided to cover the insulating substrate 202 where the grid 214, the first electrode 210, and the second electrode 212 are located. The carbon nanotube structure of the exemplary embodiment includes one or more carbon nanotube films. If multiple carbon nanotube films are employed in the carbon nanotube structure, the carbon nanotube films can be stacked successively and/or placed side-by-side in a coplanar fashion.

Step 3 includes the following steps. Firstly, the carbon nanotube film is provided. In the exemplary embodiment, the carbon nanotube film is fabricated by drawing a film from a carbon nanotube array. The carbon nanotube film includes a plurality of successive and oriented carbon nanotubes. In addition, the carbon nanotubes can be orientated along the same direction. Then, the carbon nanotube film is placed over the insulating substrate 202 along a direction extending from the second electrode 212 to the first electrode 210. That is, in each grid, the carbon nanotubes of the film are arranged end-to-end from the second electrode 212 to the first electrode 210. The carbon nanotube film is adhered to the first electrode 210 and the second electrode 212 due to the adhesiveness of the carbon nanotube film.

Furthermore, in order to enhance structural strength, after step 3, the carbon nanotube structure can then be treated with an organic solvent such as ethanol, methanol, acetone, dichloroethane or chloroform. As a result, some of the adjacent carbon nanotubes of the carbon nanotube film are bundled together so as to form a plurality of carbon nanotube bundles within the film.

Alternatively, the carbon nanotube film drawn from the carbon nanotube array can be placed on a support element (not shown). The carbon nanotube film is adhered to the support element due to the adhesiveness of carbon nanotube film. Any portion of the carbon nanotube film protruding beyond the surface of the support element is removed. The remaining carbon nanotube film is then treated with an organic solvent. For example, the organic solvent can be applied to the carbon nanotube film or the entire carbon nanotube film can be immersed in the organic solvent for treatment. The treated carbon nanotube film is then taken off from the support element. Then, the treated carbon nanotube film can be placed over the insulating substrate 202 along the direction extending from the second electrode 212 to the first electrode 210.

In step 4, the carbon nanotubes between the first electrode 210 and the second electrode 212 are cut by, for example, by laser ablation, electron beam scanning or thermal melting. In the exemplary embodiment, laser ablation is employed to break down the carbon nanotubes and then form a gap P between the first electrode 210 and the second electrode 212. Specifically, the spread carbon nanotube film is irradiated with a laser beam. The laser beam is utilized to scan and irradiate the carbon nanotube film along a direction parallel to the arrangement directions of the third electrode down-lead 206 and the fourth electrode down-lead 207. Thus, one portion of the carbon nanotube film is removed and the other portion of the carbon nanotube film between the first electrode 210 and the second electrode 212 is retained. Then, the laser beam irradiates the remaining carbon nanotube film, i.e. the portion of the carbon nanotube film between the first electrode 210 and the second electrode 212. As a result, the gap P on the carbon nanotube film is formed by breaking down the carbon nanotubes between the first electrode 210 and the second electrode 212. In addition, the gap P is formed adjacent to the first electrode 210. In the exemplary embodiment, the gap P has a width in a range from about 1 μm to about 200 μm.

Once the gap P is formed, the carbon nanotubes or bundles of carbon nanotubes broken down are substantially parallel to each other and serve as the plurality of electron emitters. The electron emitters 218 are electrically connected to the second electrode 212. That is, referring to FIG. 1, one end of each electron emitter 218 is connected to the second electrode 212. An opposite end of each electron emitter 218 serving as an electron emitting tip faces but is spaced from the first electrode 210 by a predetermined distance ranging from about 1 μm to about 1000 μm.

The method of the exemplary embodiment can further include a step 5, after step 3, providing one or more fastening elements to fasten the carbon nanotube structure on the second electrode. The fixed element is configured to fix the electron emitters to the second electrode 212 for enhancing the connection the electron emitters 218. In the exemplary embodiment, the fastening element can be made of conductive material.

In conclusion, by way of placing the carbon nanotube film and then breaking down the carbon nanotubes to form the electron emitters, it is attractive to be employed in mass production. Furthermore, the gap provided for electrons emission can be easily controlled by the method of the exemplary embodiment, obtaining precise configuration of the electron emitters.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

It is also to be understood that above description and the claims drawn to a method may include some indication in reference to certain steps. However, the indication used is only to be viewed for identification purposes and not as a suggestion as to an order for the steps.

What is claimed is:

1. A method for manufacturing a field emission element, comprising:

providing an insulating substrate;

forming at least one grid, a first electrode and a second electrode on the insulating substrate, wherein the first and second electrodes are within the at least one grid;

covering the insulating substrate having the at least one grid, the first electrode and the second electrode with a carbon nanotube structure, wherein the carbon nanotube structure comprises a plurality of carbon nanotubes, the carbon nanotubes are successively extended from the second electrode to the first electrode, and substantially orientated along a same direction; and cutting the carbon nanotubes between the first electrode and the second electrode to disconnect from the first electrode and form a plurality of substantially parallel electron emitters on the second electrode in the at least one grid, wherein one end of each electron emitter is electrically connected to the second electrode and opposite end of each electron emitter is aligned towards the first electrode.

2. The method as claimed in claim 1, further comprising a step of treating the carbon nanotube structure with an organic solvent, after covering the insulating substrate with the carbon nanotube structure.

3. The method as claimed in claim 2, wherein each of the electron emitters comprises a plurality of carbon nanotubes in a bundle structure.

4. The method as claimed in claim 2, wherein the organic solvent is selected from a group consisting of ethanol, methanol, acetone, dichloroethane and choloform.

5. The method as claimed in claim 1, wherein the step of forming the at least one grid on the insulating substrate comprises the following steps:

forming a first electrode down-lead and a second electrode down-lead substantially parallel to and spaced from each other on the insulating substrate; and forming a third electrode down-lead and a fourth electrode down-lead that intersect the first electrode down-lead and the second electrode down-lead, wherein the third electrode down-lead and the fourth electrode down-lead substantially parallel to and spaced from each other;

wherein the first electrode down-lead and the second electrode down-lead are electrically insulated from the third electrode down-lead and the fourth electrode down-lead.

6. The method as claimed in claim 5, wherein the first electrode is electrically connected to the third electrode down-lead, and the second electrode is electrically connected to the first electrode down-lead.

7. The method as claimed in claim 5, wherein before forming the third electrode down-lead and the fourth electrode down-lead, insulation is applied at the any intersections of the first electrode down-lead, the second electrode down-lead, the third electrode down-lead, and the fourth electrode down-lead.

8. The method as claimed in claim 5, wherein the step of cutting the carbon nanotubes comprises the following steps:

irradiating the carbon nanotube film along a direction parallel to the arrangement directions of the third electrode down-lead with a light beam to remove at least one portion of the carbon nanotube film and keep a portion of the carbon nanotube film between the first electrode and the second electrode; and irradiating the remainder carbon nanotube film between the first electrode and the second electrode with the light beam to break down the carbon nanotubes and form a gap on the carbon nanotube film, resulting in the plurality of substantially parallel electron emitters.

9. The field emission device as claimed in claim 8, wherein the gap has a width ranging from about 1μm to about 200μm.

10. The method as claimed in claim 5, wherein the first and second electrodes, and the first, second, third, fourth electrode down-leads are formed by a process selected from a group consisting of screen printing, sputtering and evaporating.

11. The method as claimed in claim 5, wherein a plurality of grids are formed in an array fashion, the first electrodes in a row of the grids are electrically connected to the first electrode down-lead, and the second electrodes in a column of the grids are electrically connected to the third electrode down-lead.

12. The method as claimed in claim 1, wherein the carbon nanotube structure comprises at least one carbon nanotube film.

13. The method as claimed in claim 12, wherein the step of covering the insulating substrate with the carbon nanotube structure comprises the following steps:

fabricating the at least one carbon nanotube film; and placing the at least one carbon nanotube film extending from the second electrode to the first electrode over the insulating substrate.

14. The method as claimed in claim 12, wherein a method of making the carbon nanotube structure comprises the following steps:

fabricating the at least one carbon nanotube film;

providing a support element to support the at least one carbon nanotube film;

removing any portion of the at least one carbon nanotube film protruding beyond the surface of the support element;

treating the remaining at least one carbon nanotube film with an organic solvent; and taking off the treated at least one carbon nanotube film from the support element.

15. The method as claimed in claim 14, wherein the at least one carbon nanotube film is treated by applying the organic solvent to the film or immersing the film in the organic solvent.

16. The method as claimed in claim 12, wherein the carbon nanotube structure comprises two or more stacked or coplanar carbon nanotube films.

17. The method as claimed in claim 1, wherein the carbon nanotubes are cut by a process selected from a group consisting of laser ablation, electron beam scanning and thermal melting.

18. A method for manufacturing a field emission element, comprising:

providing an insulating substrate;

forming at least one grid, a first electrode and a second electrode on the insulating substrate, wherein the first and second electrodes are within the at least one grid;

covering the insulating substrate having the at least one grid, the first electrode and the second electrode with a carbon nanotube structure, wherein the carbon nanotube structure comprises at least one carbon nanotube film, the at least one carbon nanotube film extends from the second electrode to the first electrode, and a method of making the carbon nanotube structure comprises the following steps:

fabricating the at least one carbon nanotube film;

providing a support element with a surface to support the at least one carbon nanotube film;

detach any portion of the at least one carbon nanotube film protruding beyond the surface of the support element;

treating the remaining at least one carbon nanotube film with an organic solvent; and taking off the treated at least one carbon nanotube film from the support element; and cutting the carbon nanotube film between the first electrode and the second electrode to form a plurality of substantially parallel electron emitters within the at least one grid, wherein one end of each electron emitter is electrically connected to the second electrode and opposite end of each electron emitter is aligned towards the first electrode.

19. A method for manufacturing a field emission element, comprising:

providing an insulating substrate and a carbon nanotube array;

forming at least one grid, a first electrode, and a second electrode on the insulating substrate, wherein the first and second electrodes are within the at least one grid;

drawing at least one carbon nanotube film from the carbon nanotube array, wherein the at least one carbon nanotube film comprises a plurality of successive carbon nanotubes which are substantially orientated along a same direction;

covering the insulating substrate having the at least one grid, the first electrode and the second electrode with the at least one carbon nanotube film, wherein the at least one carbon nanotube film is arranged such that the same direction extends from the second electrode to the first electrode; and cutting the at least one carbon nanotube film between the first electrode and the second electrode to disconnect the at least one carbon nanotube film from the first electrode and form a plurality of electron emitters electrically connected to the second electrode.

* * * * *